US010641576B1

(12) United States Patent
Dehlinger

(10) Patent No.: US 10,641,576 B1
(45) Date of Patent: May 5, 2020

(54) KNUCKLE-SHOT, HANDLE-LESS SLINGSHOT FRAME

(71) Applicant: Christian Dehlinger, Rockland, ME (US)

(72) Inventor: Christian Dehlinger, Rockland, ME (US)

( * ) Notice: Subject to any disclaimer, the term of this patent is extended or adjusted under 35 U.S.C. 154(b) by 0 days.

(21) Appl. No.: 16/163,392

(22) Filed: Oct. 17, 2018

(51) Int. Cl.
*F41B 3/02* (2006.01)

(52) U.S. Cl.
CPC ..... *F41B 3/02* (2013.01)

(58) Field of Classification Search
CPC ..... F41B 3/02
See application file for complete search history.

(56) References Cited

U.S. PATENT DOCUMENTS 118,108 A * 8/1871 Cleaveland ..... F41B 3/02 124/20.1
224,049 A * 2/1880 Smith ..... F41B 3/02 124/17
2,443,408 A * 6/1948 Walker ..... F41B 3/02 124/20.1
3,494,346 A * 2/1970 Yount ..... F41B 3/02 124/20.1
3,517,657 A * 6/1970 Alban ..... F41B 3/02 124/20.3
3,524,439 A * 8/1970 Dantzler ..... F41B 3/02 124/17
3,974,820 A * 8/1976 Ott ..... F41B 3/02 124/20.1
4,722,316 A * 2/1988 Stinnett ..... F41B 3/02 124/16
4,771,756 A * 9/1988 Miles ..... F41B 3/02 124/20.1
8,162,784 B1 * 4/2012 Bellefeuille ..... F42B 6/08 124/20.3
8,794,223 B2 * 8/2014 Harris ..... F41B 3/02 124/20.1
8,936,014 B2 * 1/2015 Saunders ..... F41B 3/02 124/17
9,726,451 B2 * 8/2017 Masters ..... F41B 3/02

* cited by examiner

*Primary Examiner* — John A Ricci

(57) ABSTRACT

The present invention relates to a handle-less slingshot frame with means for attaching a single, slingshot band with pouch. Frame with attached bands is worn on the fingers. When bands and pouch are drawn back over the handle-less frame, said frame operates as a class 2 lever. Upon release of ammo, said frame becomes a friction stop clip, retaining its position on the shooters fingers.

1 Claim, 3 Drawing Sheets

KNUCKLE-SHOT, HANDLE-LESS SLINGSHOT FRAME

CROSS REFERENCE TO RELATED APPLICATIONS

This application claims the benefits of provisional patent application Ser. No. 62/707,038, filed 2018 Oct. 18 by the present inventor.

DESCRIPTION

Field of Invention

The present invention pertains to slingshots and catapults; specifically to a handle-less slingshot frame, worn on the fingers, utilizing a continuous band, for propelling ammo toward a target.

Background Prior Art

All slingshot frames have 3, basic components: A handle to grasp, forks to support the bands and slingshot bands with ammo pouch to propel the ammo. All prior art of slingshot frame designs; the slingshot devices contain a handle area. This handle area becomes a portion of a class 1 lever. A class 1 lever is a stiff bar of material that has effort applied at one end, a fulcrum, that locates somewhere near the middle and resistance at the other end of the bar.

The slingshot frame becomes the bar of the lever and the shooters grip contains the forces of this class 1 lever. Effort against the slingshot forks is created by stretching the bands attached to the slingshot forks. The "fulcrum", is at the middle of the slingshot frame, at the back, top of the handle, against the web of the shooters hand. The resistance, of the class 1 lever is displaced over the front of handle, in contact with the shooters fingers.

Slingshot handles are greatly varied in size, form and materials but all slingshots, have a handle area, and are meant to be grasped by the hand, the fingers and thumb; wrapping around and squeezing the handle and frame area of the slingshot. If the slingshot is not gripped hard enough, the slingshot will come back at the shooter when its bands are stretched. If the shooter loosens their grip when ammo is released, the slingshot may leave the hand and go downrange following the ammo.

Though different systems of arm braces have been invented, and lanyards used to reduce the grip strength needed to contain slingshot lever forces; no prior art is offered that eliminates the slingshot handle and allows the slingshot frame not to be gripped at all. Furthermore, no prior art is offered where the operation of the slingshot forms a class 2 lever and a friction stop clip, during the firing cycle.

Furthermore, known slingshot frames designed with a fork, utilize a right and a left slingshot band of equal lengths, attached to an ammo pouch. The band ends opposite the pouch, in some fashion, are then attached to the right and left slingshot fork tops. Great care may be taken by the shooter, to make sure their two bands are equal in length and the pouch is centered. No one has offered a slingshot frame, with two fork tops that readily accepts a single, continuous slingshot band with attached pouch. Known art does exist that utilizes a single band. U.S. Pat. No. 3,524,439A shows a single post attachment that a continuous, unbroken band snaps into. The problem is with this design; said post attachment is in the ammo pathway. Also, it is known by slingshot shooters that bands when are very close together; as pictured in U.S. Pat. No. 3,524,439A; are unsafe. Narrow band spread, can "capture" the ammo in the pouch not releasing the ammo when firing. This causes the pouch with ammo to return back at the shooter.

SUMMARY

The current preferred embodiment of the present invention is a handle-less slingshot frame that does not have to be gripped. Said slingshot frame has fork tops for supporting slingshot bands with pouch. Further, said slingshot frame readily and properly allows for the simple attachment of a continuous, single, unbroken slingshot band.

Said frame is small and thin in form, made from a durable, single, homogenous material. Said slingshot frame has a single, large oval hole through its center that two fingers can pass through allowing fingers to slide up to their base joint. Said frame has slots and holes, in planned relationship to ammo path and the fork tops, which allows for easy attachment of a single, continuous, slingshot band with pouch. Said band installed, the band free floats within said frame for easy pouch centering. Said fork tops support the bands during the firing cycle and create the effort contact area of a class 2 lever. On said frame, below where the fingers pass through said oval hole; is the bottom portion of the frame. During the firing cycle, this bottom portion becomes an axle, fulcrum area of a class 2 lever. On said axle fulcrum, the frame articulates to the rear and the resistance portion of the class 2 lever stacks against the shooters knuckles. Upon ammo release, said frame with fork tops pivots forward. At the moment of said frames forward contact with the fingers, said frame becomes a friction stop clip and will not leave the shooters fingers in its angular position; not even with an open hand. Using the other hand and straightening the frame perpendicular to the fingers, the frame is easily removed.

DETAILED DESCRIPTION OF INVENTION

Figure 1:
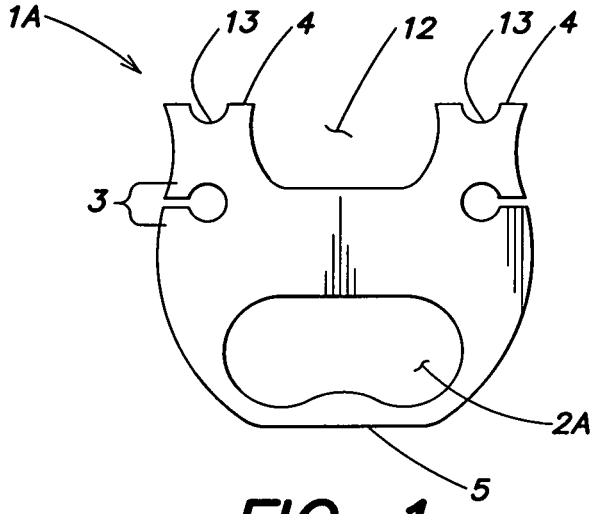
FIG. 1 shows front view of Knuckle-shot, handle less slingshot frame in its preferred embodiment for small fingers; frame body 1A.

While the scope of the invention is susceptible to frames of different forms; the preferred embodiments are shown in the drawings and described herein. It should be understood that the present disclosure is used as a preferred example of the invention. The illustrations and words used in detailed description are not meant to whatsoever limit the scope of the invention and its claims.

The present invention is a small, mostly planar, handle-less, slingshot frame that is worn on the fingers and contains the following features: A single, large, oval hole for the shooters fingers to pass through up to the base of their fingers; slots and guide holes for receiving a single continuous slingshot band (the band is not included in this application); fork tops to receive the slingshot band.

In its preferred embodiment the Knuckle-shot, handle-less slingshot frame, can be constructed of many materials such as fine plywood, polymer and metal. Said materials must be strong enough to hold up to the forces the firing cycle puts upon the frame itself. The outside form of said frame is generally an oval shape that is approximately, similar in height and width. The frame is one, planar, unitary, frame, having a left side, a right side, a top, a bottom, a front and a back. Within said frame is an oval hole for the fingers to pass through. Said oval hole is just larger than the exterior dimension of two fingers in width and approximately ⅛" to 3/16" larger in height allowing for forward and backward movement and comfortable wear. At the top of the frame of said invention, are two fork areas having tops for the bands to rest upon while being stretched during the firing cycle. There are two guide holes with slots within said frame above the oval finger hole and below the forks; a left guide hole centered under the left fork top and a right guide hole centered under the right fork top; these guide holes with slots allow for the insertion and containment of a single, unbroken slingshot band with pre-attached, ammo holding area. The shooter stretches a small section of the band and passes it through said slot; said band is then allowed to expand and rest in said guide hole(s). Said band is now free to be manipulated for centering by the shooter but is also captured within said frame. This is due to the said guide holes being larger than the diameter of said band but the expanded band is larger than said slots.

The guide holes are located in a manner which keeps the center portion of the band out of the ammos path and lined up directly under the fork top centers. Placement of the guide holes provides safe ammo release and easy band alignment across said fork tops. The large, single, oval hole is for the shooters fingers to pass through. Generally, two fingers are used but can include the ring finger for smaller hands. Also, pointer finger and thumb can be utilized for a sideways, frame relationship to the target. Below the oval finger hole is the thin, bottom portion of the frame. This retains the frame on the users' fingers and acts as the axle during the draw and firing cycle.

With said handle-less frame, on the shooters fingers and bands with pouch attached; the slingshot operates in the following fashion: Shooter places ammo in the pouch, and pulls the pouch with bands, up back and across said fork top slots which are centered above said guide holes. Choosing a target, the shooter pushes their frame hand, toward the target; the pouch is drawn rearward and the band(s) are stretched across said fork tops becoming the effort area of contact of the class 2 lever. The bottom area of said frame becomes the axle and fulcrum of a class 2 lever. The fork tops and frame mass, articulates toward the shooter and the middle of said frame rests against the shooters knuckles and becomes the resistance area of contact in the class 2 lever.

When the ammo is released, stored energy changes directions against said frame due to said band being locked in the frame. Said frame flips forward, on said axle fulcrum. The frame, contacts the back of the fingers. This contact of the effort area and the pivot area of said frame, friction brakes against the fingers. This is surprisingly not painful! Though the shooter may choose to loosely close their hand, in an "OK" fashion; no effort is needed from the shooter, to retain the frame on the hand during any portion of the firing cycle.

Figure 2:
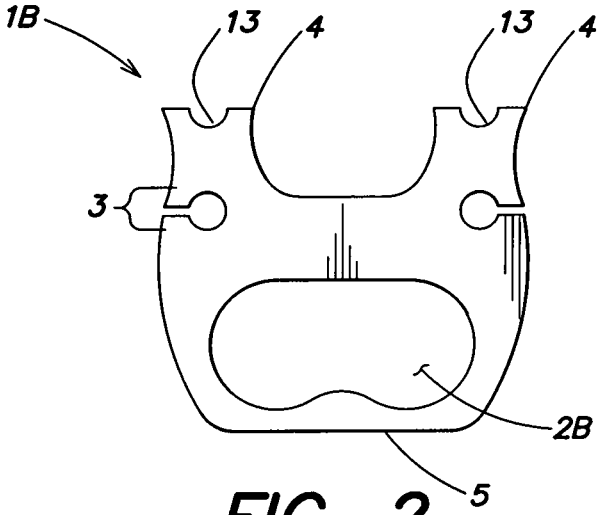
FIG. 2 shows front view of Knuckle-shot in its preferred embodiment for medium fingers; frame body 1B.
Figure 3:
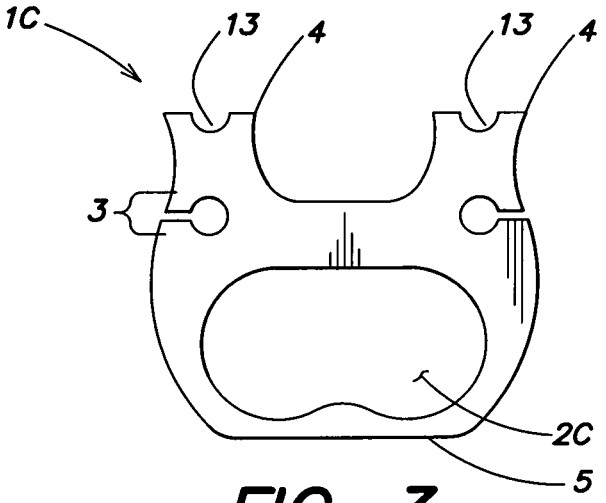
FIG. 3 shows front view of Knuckle-shot in its preferred embodiment for large fingers; frame body 1C.
Figure 4:
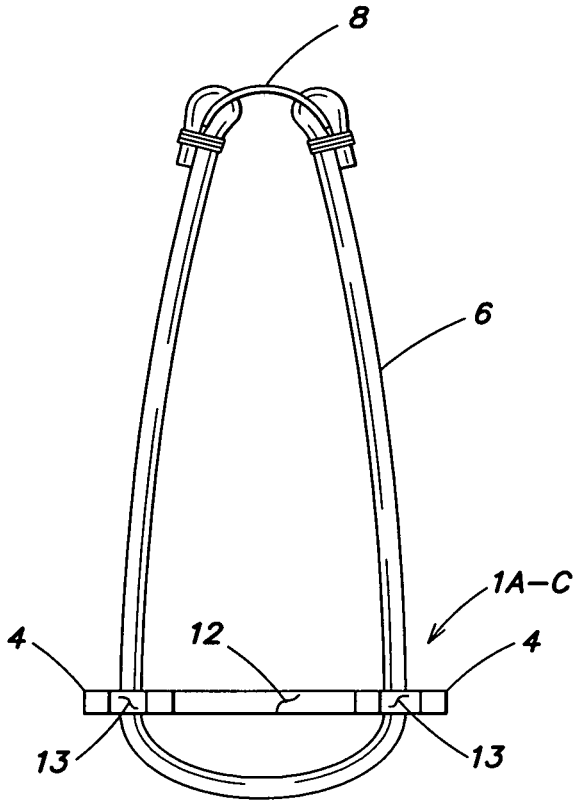
FIG. 4 shows top view of Knuckle-shot, handle less slingshot frame with single slingshot band with ammo pouch, stretched and installed in frame. Drawing represents frame bodies 1A-C.

The preferred embodiments of the Knuckle-shot, handle-less slingshot frame are:

FIG. 1-3. 1A-C, Unitary frames for various finger hole sizes: 2A-C, finger holes sized for various sized fingers: 3, slot and guide holes for band insertion and retention: 4, forks; 5, thin bottom portion of frame that becomes axle and fulcrum of a class 2 lever; 12, well area of frame for ammo pass through: 13, guide slot in fork for band lay, band stabilization and guidance during the draw and firing cycle.

FIG. 4, 1A-C, is a view of the top edge of the unitary frame; 4, fork tops; 6, single band installed, forward position; 8, attached pouch; 12, well area; 13 guide slot.

Figure 5:
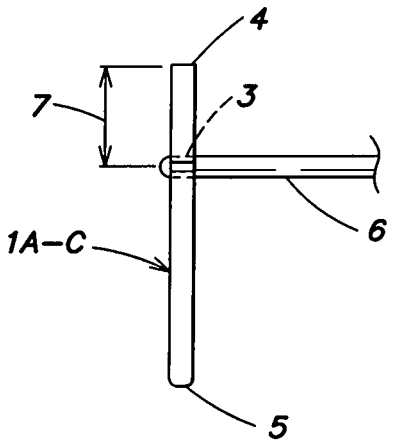
FIG. 5 shows side view of Knuckle-shot, handle less slingshot frame with single slingshot band, stretched and installed in frame: representing frame bodies 1A-C.
Figure 6:
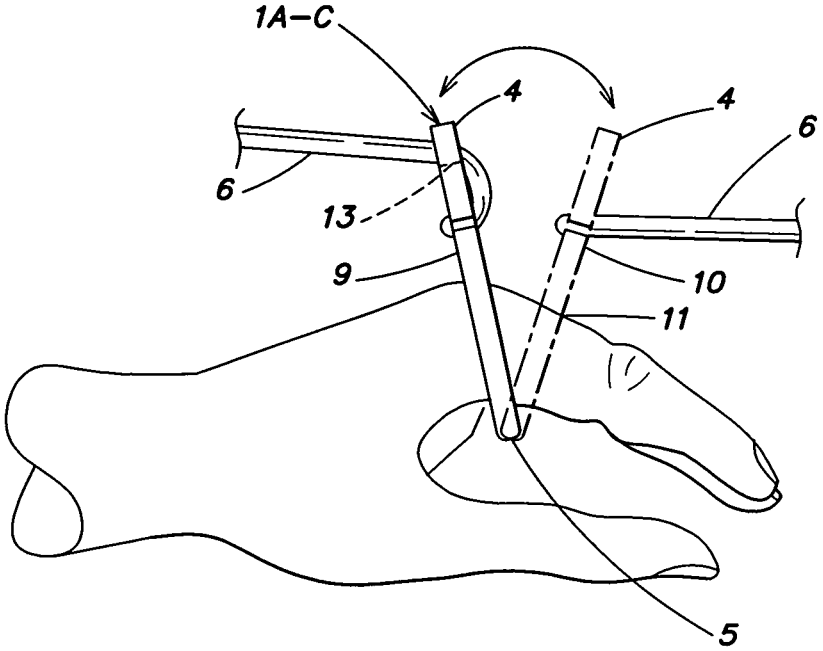
FIG. 6 shows right side view of Knuckle-shot, handle less slingshot frame on left hand fingers of open hand; articulating to the rear and then forward depicting its action during the draw and firing sequences; representing frame bodies 1A-C.

FIG. 5. 1A-C. is a view of the right side of the unitary frame; 3, slot for guide hole, 6, single band with attached pouch (not shown) with right side of single band having been stretched and inserted through slot and into guide hole; 4, fork, where 6, band will lay; 7, distance kept for 6, band, retained portion, to be located below ammo path; 6, band, shown in forward position or after release position; 5, bottom portion of unitary frame.

FIG. 6, 1A-C, Unitary frame, right side, shown on left hand fingers; numbers on backside of frame: 4, fork; 13, guide slot cradles and guides 6, elastic band with attached pouch (not shown) that has been pulled up for alignment with 13, guide slots and rearward over the fork tops, stretched toward the shooter; 9, unitary frame in pouch drawn position, levers back against knuckles; 5, bottom portion of frame becomes axle for lever movement of frame during the firing cycle; numbers on front side of frame: 4, fork, 6, band, released, going away from shooter; 1A-C, levers forward when pouch is released; 10, unitary frame, forward, in post fired position; 11, frame friction brakes on fingers stopping forward movement of the frame retaining the frame on the fingers.

Patent Citations

| Publication number | Publication date | Assignee | Title |
|---|---|---|---|
| US3524439A | 1968 Sep. 03 | Cecil H. Dantzler | Catapult |
| US3974820A | 1975 Mar. 10 | Peter Paul Ott | Catapult Device |
| US9726451B2 | 2016 Nov. 10 | Nathan Masters | Modular Slingshot |

What is claimed is:

1. A slingshot, which includes a substantially planar, unitary frame; the slingshot frame includes a body having an upper end, a lower end, a left side, a right side, a forward section and a rearward section; the frame includes a finger hole of a size to allow two or more fingers of the user to be inserted; a thin portion of the frame is defined between the bottom of the finger hole and the lower end of the frame, which allows the frame to pivot on the users hand as a lever during use; a first band slot and guide hole above the finger hole, toward the left side of the frame; a second band slot and guide hole above the finger hole, toward the right side of the frame; the first and second band slots and guide holes for receiving and securing the left and right portions of a single, elastic launching band with ammo-holding area; a first fork top extending from the frame directly above the first band guide hole; a second fork top extending from the frame directly above the second band guide hole; whereby the ammo holding area, connected to the left and right sides of the band, may be extended upward then rearward, aligning the left side of the band over the first fork top and the right side of the band over the second fork top.

* * * * *